United States Patent [19]

Forrest

[11] 4,049,267

[45] Sept. 20, 1977

[54] FOOTBALL PLACE-KICKING DEVICE

[76] Inventor: Charles Phelps Forrest, 1306 St. Stephens Road, Mobile, Ala. 36603

[21] Appl. No.: 709,005

[22] Filed: July 26, 1976

[51] Int. Cl.[2] ..... A63B 67/00

[52] U.S. Cl. ..... 273/55 B

[58] Field of Search ..... 273/55 B

[56] References Cited

U.S. PATENT DOCUMENTS

| | | | |
|---|---|---|---|
| 3,105,686 | 10/1963 | Elsea | 273/55 B |
| 3,439,916 | 4/1969 | Kopp | 273/55 B |
| 3,516,667 | 6/1970 | Williams | 273/55 B |
| 3,897,948 | 8/1975 | Gerela | 273/55 B |

*Primary Examiner*—Richard C. Pinkham
*Assistant Examiner*—T. Brown
*Attorney, Agent, or Firm*—Cameron, Kerkam, Sutton, Stowell & Stowell

[57] ABSTRACT

A football place-kicking device for holding a football at any desired kicking position on a playing surface to practice place-kicking. The device includes a base, an L-shaped arm extending laterally from the base arranged to pivot on the base in a vertical plane, and a semi-rigid horizontal ball-engaging arm extending horizontally from the upper end of the L-shaped arm to support a football between the base and the ball-engaging arm.

8 Claims, 3 Drawing Figures

FOOTBALL PLACE-KICKING DEVICE

BACKGROUND OF THE INVENTION

The present invention pertains to an improved football-kicking device which permits a kicker to practice without the assistance of another player to hold the ball on the bround or playing surface as it is being kicked, and more particularly to an adjustable place-kicking device which can hold the ball at any desired angle to the verical.

Modern football is a game of specialists who can perform a specific task well. One such specialist is a place-kicker who is required to kick a football, held on a playing surface by another player, various distances at varying trajectories with a great degree of accuracy. To acquire these skills, a place-kicker puts in many long hours on the practice field perfecting his skills in kicking a footbal at different trajectories. On many of these practice sessions the kicker is unable to find a player to hold the ball on the ground as he kicks it; therefore, he must use a kicking tee or one of the presently available practice place-kicking devices.

While a number of kicking tee constructions have been provided, such, for the most part, have not effectively released the ball in such a manner as to provide the trajectory necessary for a given distance of travel. Some recently proposed kicking tees have been capable of releasing the ball in a manner which does not adversely affect its travel. However, these devices do not provide sufficient force to hold the football in place and at the desired angle prior to being kicked.

Representative of the available practice kicking devices are those disclosed in U.S. Pat. Nos. 3,105,686, 3,762,706, and 3,897,948. These prior art devices are suitable for limited place-kicking situations; however, they are designed for supporting a football in a substantially vertical position. With the greater importance on field goals and extra points in the game of football, greater emphasis is placed on the vertical angle at which the ball is held prior to its being kicked. The closer the ball is to the vertical when kicked, the lower its trajectory, and the further the ball is tilted from the vertical when kicked, the higher its trajectory.

SUMMARY OF THE INVENTION

The present invention provides a portable practice place-kicking device adapted to hold a football at any desired kicking angle comprising:

a. a base;

b. an L-shaped arm arranged to pivot on the base in a vertical plane;

c. a rigid upper horizontal arm portion extending from the upright portion of the L-shaped arm;

d. A semi-rigid ball-engaging arm mounted on the free end of the horizontal arm portion adapted to be deformed for engagement with the upper end of a football to hold it at a desired angle by applying a downward force to the football as it is supported on the base.

It is therefore a primary object of this invention to provide a football place-kicking device which can be adjusted to any desired kicking angle.

Another object of this invention is to provide a football place-kicking device with a horizontally extending ball-engaging arm capable of applying the necessary downward pressure on a football at any desired angle, thereby closely approximating the conditions encountered when the football is manually held.

Another object is to provide a football place-kicking device comprising a supporting base and a vertically spaced ball-engaging arm for releasably engaging the upper end of a football positioned on the base.

Still another object of this invention is to provide a novel football place-kicking device comprised of a minimum number of parts, and which is rugged, durable, and relatively economical to manufacure and maintain.

Other objects and advantages of this invention will become apparent from the following detailed description thereof and the accompanying drawings wherein.

DESCRIPTION OF THE PREFERRED EMBODIMENT

Figure 1:
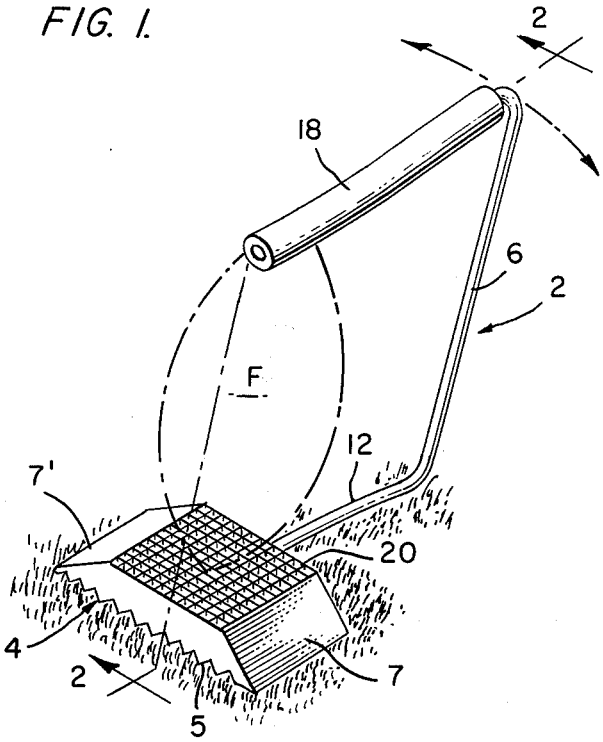
FIG. 1 is a perspective view of a place-kicking device embodying the invention.
Figure 2:
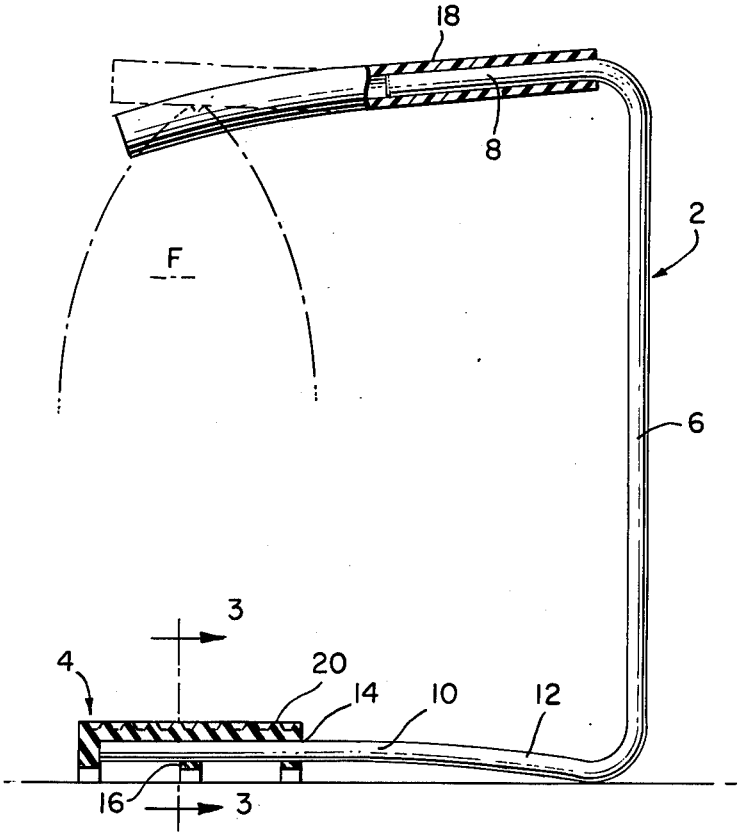
FIG. 2 is a vertical cross-sectional view taken along the line 2—2 of FIG. 1.

Referring now to the drawings, and particularly to FIGS. 1 and 2, there is shown a place-kicking device generally designated by the reference numeral 2. Place-kicking device 2 includes a base 4 designed to support a football and the football holding components of the invention described hereinafter while resting upon a playing surface without being otherwise attached thereto. The base 4 is of substantially traezoidal shape in side elevation, is made of a molded plastic, rubber or metal material, and is provided with a relatively large toothed or serrated surface 5 in contact with the playing surface in order to counteract any tipping tendency caused by the ball-holding components which are pivoted from base 4. The trapezoidal shape of the base also provides inclined surfaces 7 and 7' which avoid interference with the foot of the kicker when the ball is kicked, depending upon whether the kicker is right-footed or left-footed.

Pivoted to base 4 and projecting upwardly is an arm 6 constructed of a rigid material such as metal, plastic or the like. Arm 6 has horizontally extending upper and lower portions 8 and 10, respectively. Lower arm portion 10 is perpendicular to arm 6 and has a lightly bent foot section 12 to contact the ground surface and stabilize the base 4. The base 4 has a pair of aligned apertures 14 and 16 which frictionally receive the free end of arm portion 10 and retain the arm 6 at any desired angle to the vertical. Other suitable means for holding the arm 6 at any desired angle may be used in place of the frictional surfaces of apertures 14 and 16 without departing from the invention.

The upper arm portion 8 is directly slightly downwardly, as shown in the drawing, from the line of arm 6. The angle of the arm portion 8 when measured from a line along the arm 6 should not exceed 90° and is preferably between 80° and 90°.

A semi-rigid tubular ball-engaging arm 18 is adapted to fit snugly over the free end of the upper arm portion 8. As shown in the drawing, arm 18 is tubular and constructed of a semi-rigid material. The term "semi-rigid" means being deformable by having a proclivity to resume an original shape. One example of a material suitable for use as arm 18 is a length of commonly available plastic garden hose of the type reinforced with nylon or polyester cord. Arm 18 may also be formed of such semi-rigid materials as hard rubber, plastic, and the like; it may have a variety of cross-sectional configurations.

The length of arm 18 is such as to extend over the base 4 when the device 2 is completely assembled. As shown in FIG. 2, it is preferable that the arm 18 in its undeformed state be shaped to have a slight downward curvature along its length to provide a downward biasing force against a football when held on the base 4.

The lower arm portion 10 is of a greater length than the upper arm 8 to allow for kicking through the football without touching the upper arm portion 8. The length of semi-rigid ball-engaging arm 18 when added to the exposed length of arm portion 10 extends across the base 4 to assure good contact with the upper end of a football F.

As shown in FIG. 2, the length of arm 6 is such that upper arm portion 10 is above the top end of a football F. By deforming ball-engaging arm 18 and placing the lower end of the football on base 4, and then resting the free end of arm 18 on the upper end of the ball, the ball may be held at any desired angle to the vertical. The semi-rigid nature of the material of arm 18, together with its mounting to arm portion 8 which is above upper end of the football F, provides a substantially point contact between the arm 18 and the top of the football. This feature of point contact simulates a manual ball holder and provides for the necessary stability of arm 18 in the deformed state to assure that the football will be held steady at any desired angle.

The downward pressure applied to the ball by the deformed arm 18 is approximately equivalent to the pressure applied by the finger of a manual holder and simulates game conditions. Depending upon the preference of the kicker, the vertical angle of the football can be changed without affecting the point contact pressure applied by arm 18.

Figure 3:
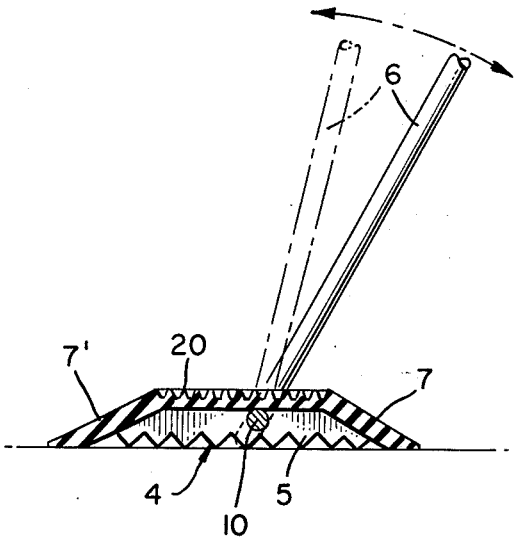
FIG. 3 is a partial cross-sectional view of the place-kicking device taken along the line 3—3 of FIG. 2.

FIG. 3 shows the base 4 with a roughened or serrated supporting surface 20 upon which the lower end the football rests. The cross-section of the base 4 shown at FIG. 3 has the geometrical shape of a trapezoid giving the base more stability when the ball is kicked. As previously mentioned, lower arm portion 10 extending from base 4 has a slightly bent foot section 12 forming an outrigger which engages the ground, thereby adding to the stability of the device.

In use, the place-kicking device of the present invention is placed on a playing surface or practice field and deformable ball-engaging arm 18 is flexed upwardly to allow a football F to be placed on serrated surface 20 of base 4. When the desired angle of trajectory is determined and arm 6 is so adjusted, the free end of deformable arm 18 is released to contact the upper end of the ball thus supporting it on the base at the desired angle to the vertical.

It is understood that the place-kicking device 2 of the present invention may be used by either a soccer-style kicker who approaches the ball from an angle to the desired line of flight or a conventional straight-head kicker who approaches the ball directly from behind the line of flight. It is also usable by either a right-footed kicker or a left-footed one.

Although only one specific form of place-kicking device has been described and illustrated in the drawing, it will be understood that various modifications and changes may be made by those skilled in the art without departing from the inventive concept. Reference should therefore be had to the appended claims for a definition of the scope of the invention.

What is claimed is:

1. A football place-kicking device comprising:

a. a base adapted to support the lower end of a football;

b. an upright arm mounted on said base for pivotal movement in a vertical plane relative to said base;

c. a rigid upper arm and a rigid lower arm, each having one of its ends attached to said upright arm and each extending substantially horizontally from said upright arm, said lower arm portion having its other end frictionally attached to said base so as to allow said upright arm to pivot in a vertical plane; and d. a semi-rigid ball-engaging arm mounted on the other end of said upper arm portion, said ball-engaging arm being adapted to be deformed for engagement with the upper end of a football when supported on said base, for holding said footall in a substantially upright position.

2. A football place-kicking device as claimed in claim 1 wherein said lower arm portion is substantially perpendicular to said upright arm and includes a bent foot portion adapted to engage the ground and stabilize said base.

3. A football place-kicking device as claimed in claim 1 wherein said upper arm portion is bent at an angle less than 90° relative to said upright arm.

4. A football place-kicking device as claimed in claim 1 wherein said upper arm portion is of a length less than said lower arm portion.

5. A football place-kicking device as claimed in claim 4 wherein said semi-rigid ball-engaging arm is of tubular material which is slipped over the free end of said upper arm portion and extends over said base.

6. A football place-kicking device as claimed in claim 1 wherein said base has a roughened or serrated football supporting surface and a toothed or serrated bottom surface for engagement with a playing surface.

7. A football place-kicking device as claimed in claim 1 wherein said base is of trapezoidal shape in side elevation providing an inclined surface facing the kicker.

8. A football place-kicking device as claimed in claim 1 wherein said base includes a pair of aligned apertures frictionally receiving said lower arm portion of said upright arm to frictionally hold said upright arm at a selected angle to the vertical.

* * * * *